US006200054B1

(12) United States Patent
Chen

(10) Patent No.: US 6,200,054 B1
(45) Date of Patent: Mar. 13, 2001

(54) DEVICE FOR INJECTING FILLING INTO CRACKS OF WALL

(76) Inventor: Chen Hui Chen, No. 365, Da Jen North Road, Gang San Town, Kaoshing Hsien (TW)

( * ) Notice: Subject to any disclaimer, the term of this patent is extended or adjusted under 35 U.S.C. 154(b) by 0 days.

(21) Appl. No.: 09/502,225

(22) Filed: Feb. 11, 2000

(51) Int. Cl.[7] ..... B43K 5/18

(52) U.S. Cl. ..... 401/150; 401/176; 401/265; 222/386; 425/12; 604/143; 604/146

(58) Field of Search ..... 401/143, 146, 401/149, 150, 176, 171, 261, 263, 265, 266; 222/386; 425/12; 417/375; 604/68, 70, 72, 140, 141, 143, 146

(56) References Cited

U.S. PATENT DOCUMENTS 4,040,420 * 8/1977 Speer ..... 128/218
4,790,824 * 12/1988 Morrow et al. ..... 604/143
4,961,883 * 10/1990 Jacino et al. ..... 425/12

* cited by examiner

*Primary Examiner*—Henry J. Recla
*Assistant Examiner*—Tuan Nguyen
(74) *Attorney, Agent, or Firm*—Charles E. Baxley

(57) ABSTRACT

An injection device for injecting a filling into a wall includes a filling housing having a nozzle, and a plunger slidably engaged in the housing for drawing and injecting the filling relative to the housing. One or more vacuuming housings are secured to the filling housing and each has a plunger for vacuuming the vacuuming housing. The vacuuming housing plunger may force the plunger of the filling housing to inject the filling into the cracks of the walls. The plungers may be secured to the respective housing and may be disengaged from the housing when required.

10 Claims, 4 Drawing Sheets

DEVICE FOR INJECTING FILLING INTO CRACKS OF WALL

BACKGROUND OF THE INVENTION

1. Field of the Invention

The present invention relates to an injection device, and more particularly to an injection device for injecting filling into cracks of walls.

2. Description of the Prior Art

Typically, walls or the like may include various kinds of cracks formed therein. A filling or the like may be required to be injected into the cracks, but may not be easily injected into the cracks of the walls.

The present invention has arisen to mitigate and/or obviate the afore-described disadvantages of the conventional the injection devices.

SUMMARY OF THE INVENTION

The primary objective of the present invention is to provide an injection device for effectively injecting a filling into the cracks of the walls.

In accordance with one aspect of the invention, there is provided an injection device for injecting a filling into a wall, the injection device comprising a first syringe including a first housing having a nozzle provided thereon for allowing the filling to be drawn into and injected out of the first housing, and a first plunger slidably engaged in the first housing for drawing and injecting the filling out of the first housing, and means for forcing the first plunger into the first housing to force the filling out of the first housing.

The forcing means includes at least one second syringe having a second housing secured to the first housing, and a second plunger slidably engaged in the second housing for vacuuming the second housing when the second plunger is pulled outward of the second housing, the second plunger is engaged with the first plunger to force the first plunger into the first housing to force the filling out of the first housing.

A securing device is further provided for securing the second housing to the first housing and includes a first securing device provided on the first housing, and a second securing device provided on the second housing and engaged with the first securing device for securing the second housing to the first housing.

A device is further provided for releasably securing the first plunger and/or the second plunger to the first housing and/or the second housing respectively, and includes at least one aperture formed in the first plunger, and a retaining rod engaged in the first housing and engaged through the aperture of the first plunger to secure the first plunger to the first housing.

The second housing includes a port, and a cap detachably engaged onto the port for enclosing the second housing and for releasing the vacuuming status of the second housing.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
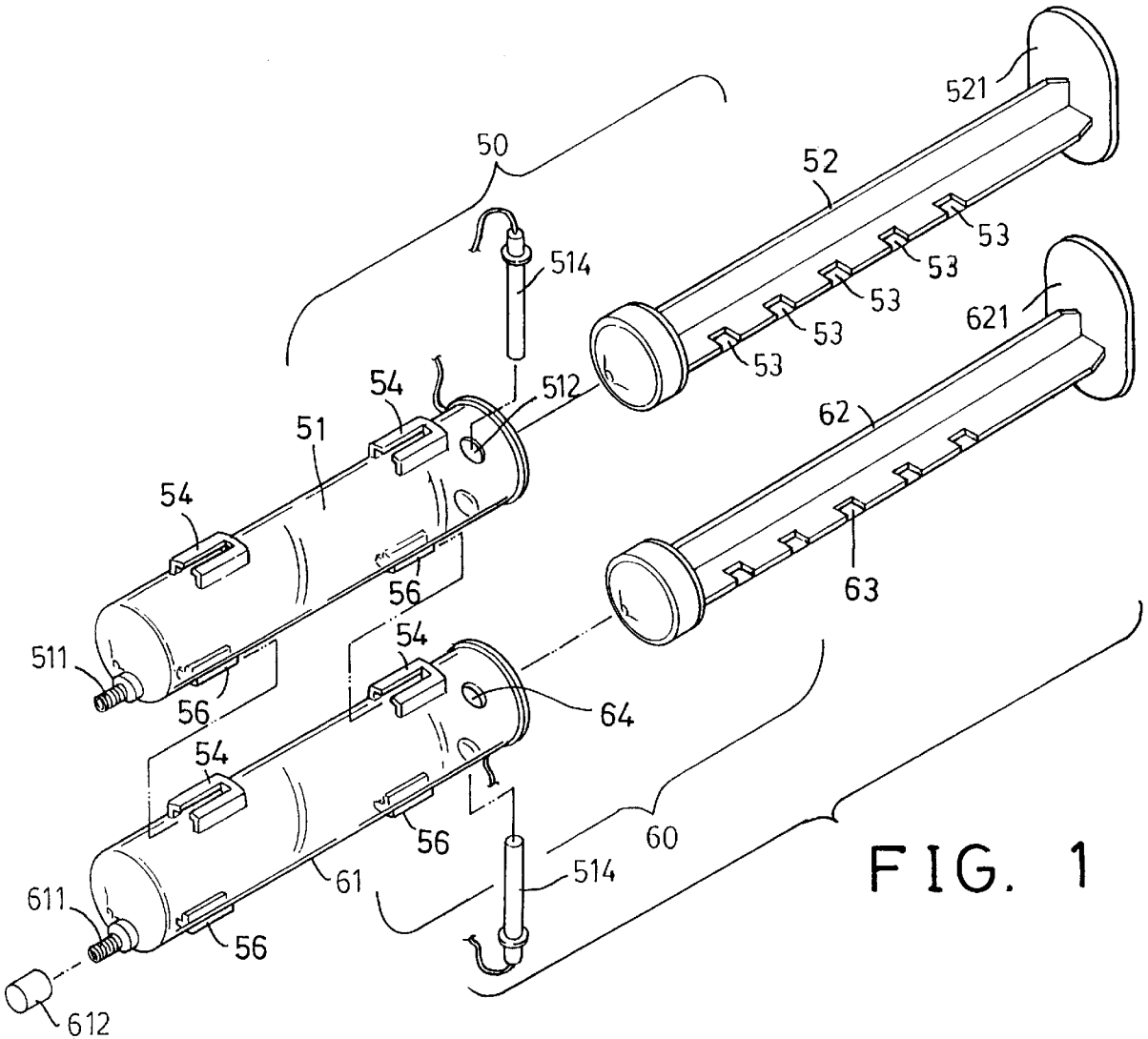
FIG. 1 is an exploded view of an injection device in accordance with the present invention.
Figure 2:
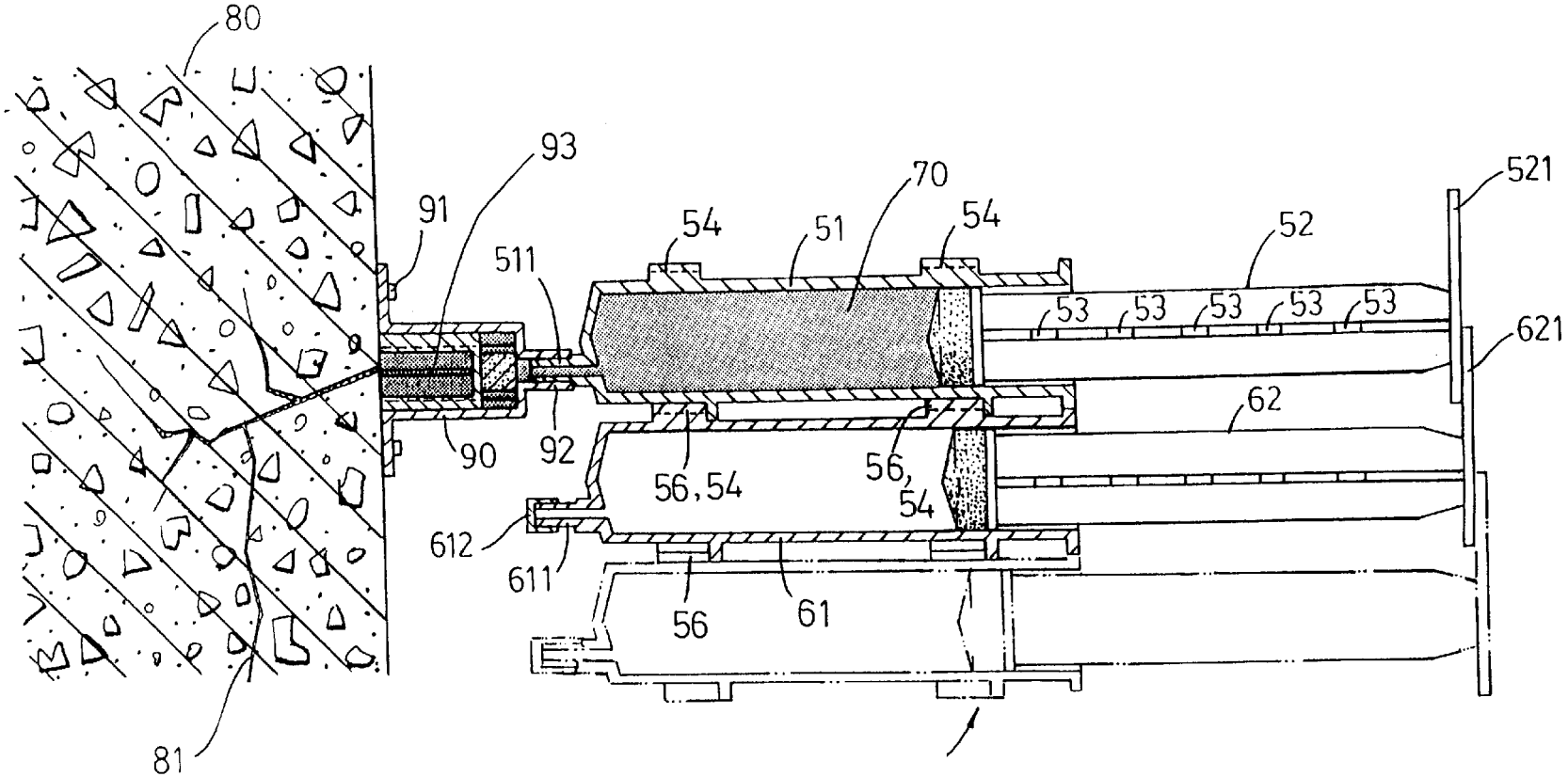
FIG. 2 is a cross sectional view of the injection device.

Referring to the drawings, and initially to FIGS. 1 and 2, an injection device in accordance with the present invention comprises a syringe 50 for drawing and for filling a filling 70 into the cracks 81 of the wall 80, and one or more syringes 60 coupled to the syringe 50 for facilitating the operation of the syringe 50. The syringe 50 includes a housing 51 for slidably receiving a plunger 52 and having a nozzle 511 provided in one end for drawing the filling 70 into the housing 51 and for injecting the filling 70 out of the housing 51. The housing 51 includes one or more female securing devices 54, for example, and one or more male securing devices 56 provided thereon and preferably opposite to the female securing devices 54. The plunger 52 includes one or more apertures 53 formed therein and includes a knob 521 provided on the rear end thereof. A retaining device, such as a retaining rod 514 is engageable into the orifice(s) 512 of the housing 51 and engageable into either of the apertures 53 of the plunger 52 for releasably securing the plunger 52 to the housing 51 at the required position.

The syringe(s) 60 each includes housing 61 having one or more female securing devices 54, for example, provided thereon for engaging with the male securing devices 56 of the housing 51 and for securing the housings 51, 61 together, and having one or more male securing devices 56 provided thereon and preferably opposite to the female securing devices 54 for engaging with the female securing devices 54 of the further housings 61, as shown in dotted lines in FIG. 2. A plunger 62 is slidably received in the housing 61 for vacuuming the interior of the housing 61, and includes one or more apertures 63 formed therein and includes a knob 621 provided on the rear end thereof. A retaining device, such as a retaining rod 514 is engageable into the orifice(s) 64 of the housing 61 and engageable into either of the apertures 63 of the plunger 62 for securing the plunger 62 to the housing 61 at the required position.

A socket 90 may be secured to the wall 80 with fasteners 91 for example, and includes a mouth 92 formed on one end thereof and includes a passage 93 formed therein and communicating the mouth 92 with the cracks 81 of the wall 80. The nozzle 511 of the housing 51 may be engaged into and secured to the mouth 92 of the socket 90 for allowing the filling 70 to be injected into the cracks 81 of the wall 80 via the passage 93 of the socket 90. The housing 61 includes a port 611 detachably enclosed with a cap 612 for allowing the air to flow into the housing 61 when required and for releasing the vacuuming of the housing 61.

In operation, the filling 70 may first be drawn into the housing 51 with the plunger 52 which may be secured to the housing 51 with the retaining rod 514. The housing 61 may be vacuumed by pulling the plunger 62 outward of the housing 61 and the plunger 62 may be secured to the housing 61 with the retaining rod 514. As shown in FIG. 2, the housing 61 is secured to the housing 51 and the nozzle 511 of the housing 51 is engaged with the mouth 92 of the socket 90, the knob 621 is engaged with or secured to the knob 521 of the plunger 52. When the retaining rod 514 is disengaged from the plunger 62 and the housing 61 and when the other retaining rod 514 is disengaged from the plunger 52 and the housing 51, the plunger 62 may be drawn and forced inward of the housing 61 by the vacuuming of the housing 61, and the plunger 52 may be forced inward of the housing 51 by the plunger 62 to fill and to inject the filling 70 into the cracks 81 of the wall 80. The vacuum force in the housing 61 may uniformly draw the plunger 62 inward of the housing 61.

Figure 3:
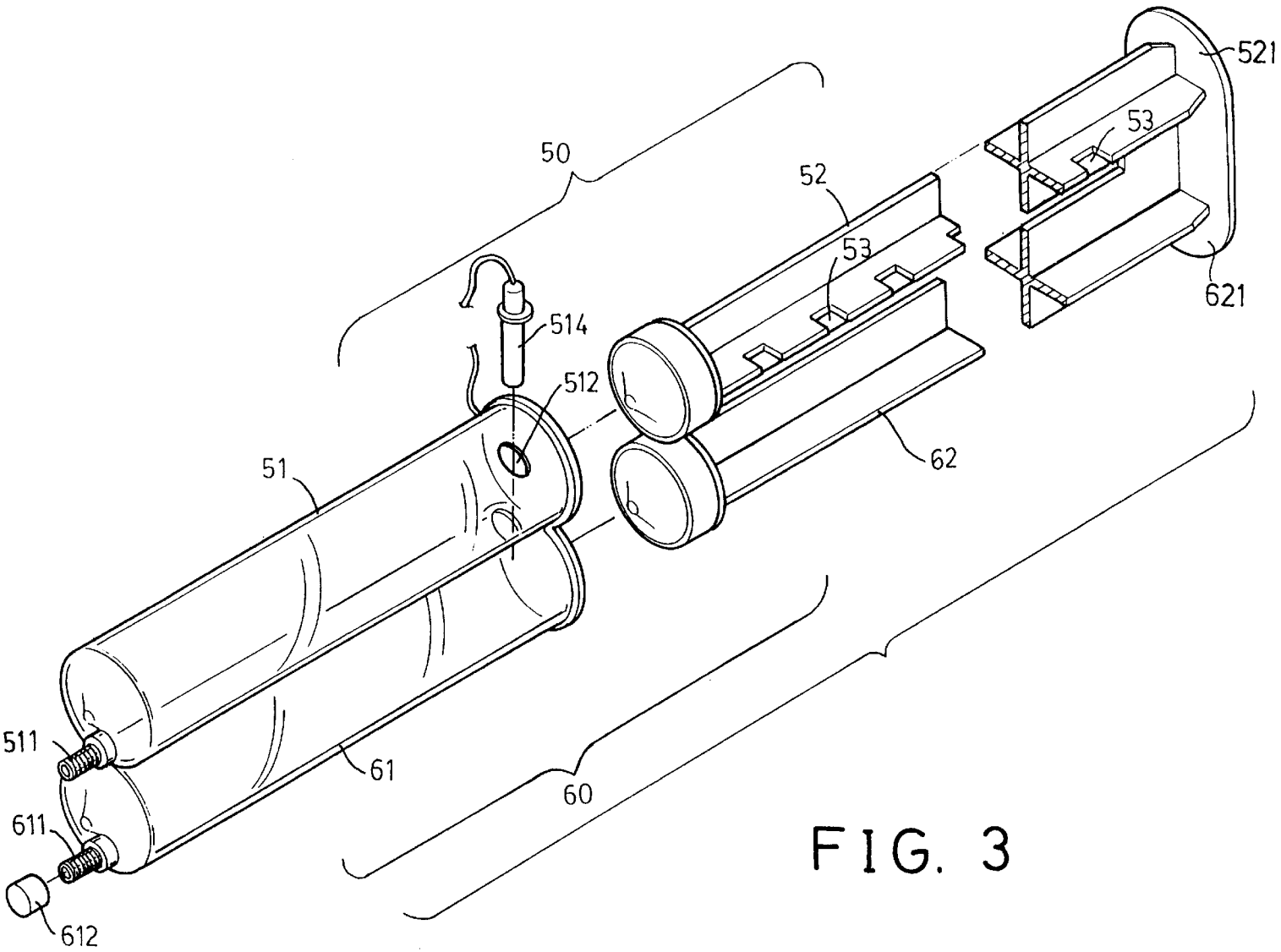
FIG. 3 is an exploded view illustrating the other application of the injection device.
Figure 4:
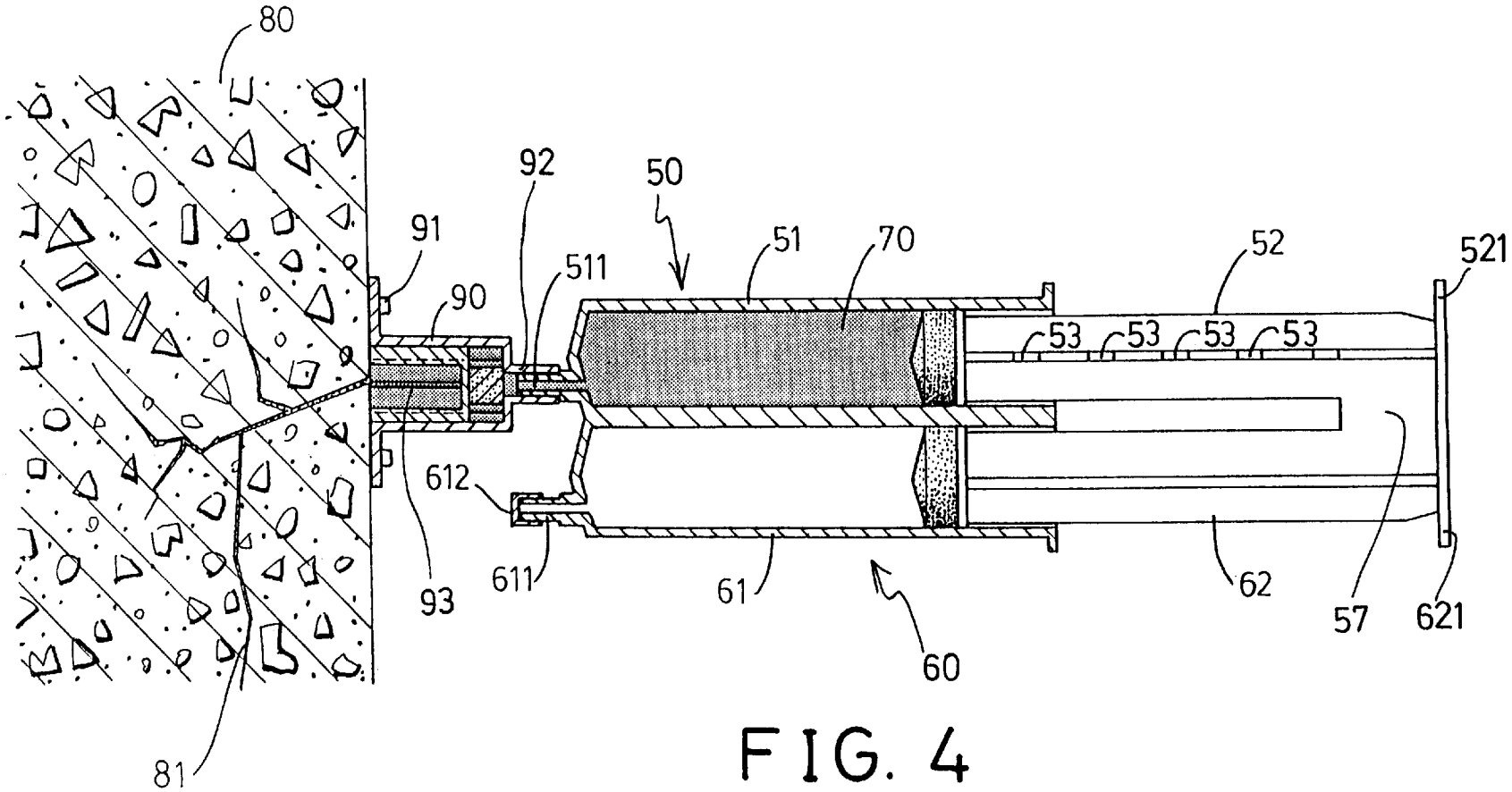
FIG. 4 is a cross sectional view of the injection device as shown in FIG. 3.

Referring next to FIGS. 3 and 4, alternatively, the knobs 521, 621 and/or the rear portions 57 of the plungers 52, 62 may be secured together or may be formed as an integral one piece unit, such that the plungers 52, 62 may be moved in concert with each other. Further alternatively, the housings 51, 61 of the syringes 50, 60 may also be secured together or may be formed as an integral one piece unit.

Accordingly, the injection device in accordance with the present invention may be used for effectively injecting a filling into the cracks of the walls.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An injection device for injecting a filling into a wall, said injection device comprising:

a first syringe including a first housing having a nozzle provided thereon for allowing the filling to be drawn into and injected out of said first housing, and a first plunger slidably engaged in said first housing for drawing the filling into and injecting the filling out of said first housing, and means for forcing said first plunger into said first housing to force the filling out of said first housing wherein said forcing means includes at least one second syringe having a second housing secured to said first housing, and a second plunger slidably engaged in said second housing for vacuuming said second housing when said second plunger is pulled outward of said second housing, said second plunger is engaged with said first plunger to force said first plunger into said first housing to force the filling out of said first housing.

2. The injection device according to claim 1 further comprising means for securing said second housing to said first housing.

3. The injection device according to claim 2, wherein said securing means includes a first securing device provided on said first housing, and a second securing device provided on said second housing and engaged with said first securing device for securing said second housing to said first housing.

4. The injection device according to claim 1 further comprising means for releasably securing said first plunger to said first housing.

5. The injection device according to claim 4, wherein said releasably securing means includes at least one aperture formed in said first plunger, and a retaining rod engaged in said first housing and engaged through said at least one aperture of said first plunger to secure said first plunger to said first housing.

6. The injection device according to claim 4 further comprising means for releasably securing said second plunger to said second housing.

7. The injection device according to claim 6, wherein said second plunger releasably securing means includes at least one aperture formed in said second plunger, and a retaining rod engaged in said second housing and engaged through said at least one aperture of said second plunger to secure said second plunger to said second housing.

8. The injection device according to claim 1 further comprising means for releasably securing said first plunger to said first housing.

9. The injection device according to claim 8, wherein said releasably securing means includes at least one aperture formed in said first plunger, and a retaining rod engaged in said first housing and engaged through said at least one aperture of said first plunger to secure said first plunger to said first housing.

10. The injection device according to claim 1, wherein said second housing includes a port, and a cap detachably engaged onto said port for enclosing said second housing.

* * * * *